United States Patent [19]

McGregor

[11] 4,147,106

[45] Apr. 3, 1979

[54] TAG FEEDING APPARATUS

[76] Inventor: Harold R. McGregor, 715 Cardinal Dr., Owatonna, Minn. 55060

[21] Appl. No.: 812,850

[22] Filed: Jul. 5, 1977

[51] Int. Cl.[2] ..... B41F 13/24

[52] U.S. Cl. ..... 101/232; 271/22

[58] Field of Search ..... 101/232–243; 271/19–25; 93/34, 73, 87–89

[56] References Cited

U.S. PATENT DOCUMENTS

| | | | |
|---|---|---|---|
| 825,264 | 7/1906 | Dick | 271/22 |
| 893,510 | 7/1908 | Juengst | 270/58 |
| 2,177,615 | 10/1939 | Autem | 101/44 |
| 3,325,164 | 6/1967 | Kedzierski | 271/21 |
| 3,350,089 | 10/1967 | Niccoli | 271/21 |

*Primary Examiner*—Edgar S. Burr
*Assistant Examiner*—A. Heinz
*Attorney, Agent, or Firm*—Williamson, Bains, Moore & Hansen

[57] ABSTRACT

A tag feeding machine particularly adapted for separating thin paper tags, of the type applied to feed bags, one at a time from a stack. A tag engaging member mounted on a movable arm and having a friction contact surface thereon is movable through a predetermined path on a displacement stroke wherein it contacts the first tag in a stack and buckles its leading edge out from engagement by a leading edge retaining member on a tag holder. As the tag engaging member moves back through a return stroke to a rest position, it carries the separated tag's leading edge forwardly to a freely disposed pickup location. Tag pickup means in the form of a swingable delivery arm having a pickup device on one end grips the freed leading edge of a separated tag and delivers it to an application location.

A printing head positioned adjacent the rear or trailing end of stacked tags is movable by power means on a printing stroke to apply printed matter to the first tag in a stack immediately prior to the buckling and separating of the leading edge of the first tag by the movement of the aforesaid tag engaging member on its displacement stroke.

20 Claims, 10 Drawing Figures

TAG FEEDING APPARATUS

BACKGROUND OF THE INVENTION

The tag feeding apparatus of this invention is a variation of that disclosed in my co-pending application filed Dec. 8, 1975, Ser. No. 638,757, entitled METHOD AND APPARATUS FOR FEEDING TAGS and issued as U.S. Pat. No. 4,038,922 on Aug. 2, 1977. This application is a Continuation-In-Part of my aforesaid, earlier filed application. The machine disclosed herein utilizes the same concept of separating tags one at a time from a stack and utilizing a movable arm with a gripping device on it to pick up the separated tags and deliver them one at a time to a position of application to a bag or other container.

However, rather than employing a reciprocating plate type of device to separate tags one at a time, this invention utilizes a buckling device which is particularly effective to separate tags made from relatively thin paper, such as the type commonly applied to feed bags. The buckling device is operable to buckle the leading end of the first tag in a stack to a position where it is free from engagement by a retaining member for pickup by delivery means of some kind. Known prior art machines have been unsatisfactory for separating and delivering printed tags of relatively thin, paper stock. The "buckling" principle utilized in this invention overcomes these problems, and has proven to operate particularly successfully in applications requiring the separation of thin, paper tags.

BRIEF SUMMARY OF THE INVENTION

The tag feeding apparatus of this invention is particularly characterized by a tag holding assembly and a tag separating mechanism which cooperate to automatically separate tags one at a time from a stack and to position each separated tag for pickup and delivery to an application location. The apparatus is particularly adapted to effectively separate various sizes of thin tags such as those made from paper stock. A printer is combined with the tag holding assembly and the tag separating mechanism in such a way as to permit printing, coding and date information on one end of each tag immediately prior to delivery and application.

These objects and advantages are achieved by a tag engaging, friction contact member which is moved through a displacement stroke to buckle the leading edge of the first tag in a stack out from engagement by a leading edge tag retainer. The tag engaging member forms part of the tag separating mechanism and is preferably mounted on a tag displacement arm. This arm is movable to carry the tag engaging member through the tag displacement stroke as well as through a return stroke wherein the tag engaging member positions the tag leading end at a pickup location free from the leading edge retainer.

The tag holding assembly advantageously comprises the aforesaid leading edge retainer positioned at an output side of the holding assembly, a rear stop device positioned to be in restraining relation to the rear edges of stacked tags, follower means positioned to bear outwardly against the last tag in a stack, and an outer stack holder positioned between the rear stop device and the leading retainer to bear inwardly against the tag stack in opposed relation to the follower means. On the displacement stroke of the tag displacement arm the tag engaging member urges the leading edge of the first tag rearwardly against the rear stop device to thereby buckle the leading end of the first tag free of the leading edge retainer. On the return stroke of the tag displacement arm, the tag engaging member moves the leading end of the first tag back forwardly to a freely disposed pickup position adjacent the output side of the tag holding assembly.

The tag feeding apparatus also preferably comprises a tag delivery arm movable between a tag pickup position adjacent the output side of the tag holding assembly and a remote tag delivery position. The tag displacement arm and the delivery arm are preferably swingably movable. These two arms are so connected to power means with respect to each of their pivot point locations as to be movable in opposite directions simultaneously through paths wherein the displacement arm moves rearwardly on its displacement stroke to free the first tag in a stack as the delivery arm is swung forwardly to its delivery position with a previously displaced tag. The displacement arm moves forwardly through its return stoke to position a tag for pickup as the delivery arm swings rearwardly to its tag pickup position. The tag delivery arm carries a tag pickup device, preferably movable clamping jaws.

A particularly advantageous feature of the tag feeding apparatus of this invention resides in the utilization of a printing head positioned between the rear stop device and the outer stack holder. The printing head is movable on a printing stroke to imprint coding information on a tag immediately prior to the buckling and separating of the leading end of a tag by the tag engaging member.

The tag holding assembly is adjustable to accommodate different sizes of tags. To this end the rear stop device is adjustable laterally towards and away from the leading edge retainer to permit tags of varying length to be stacked therebetween.

These and other objects and advantages of this invention will become readily apparent as the following description is read in conjunction with the accompanying drawings wherein like reference numerals have been utilized to designate like elements throughout the several views.

DESCRIPTION OF THE PREFERRED EMBODIMENT

Figure 1:
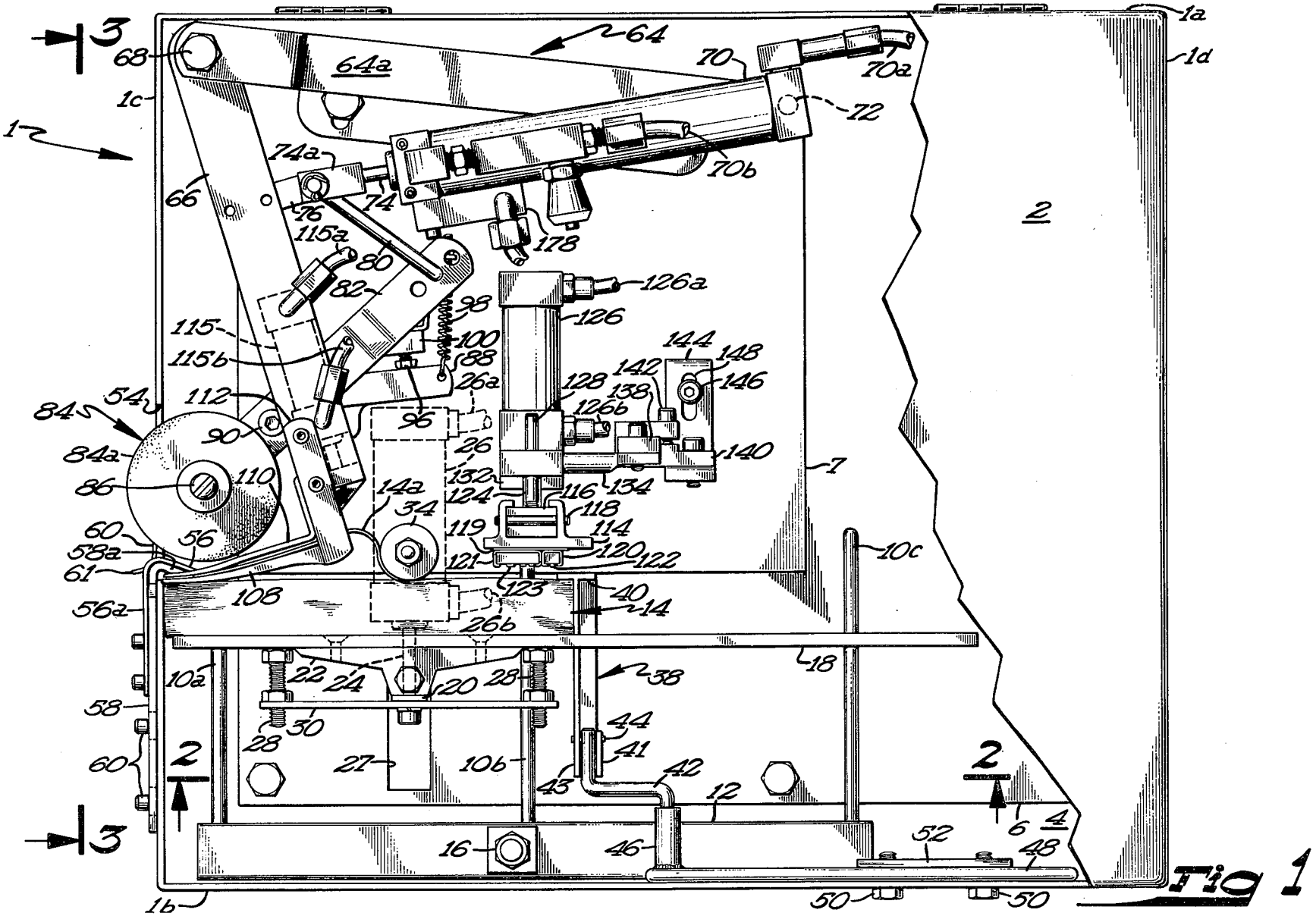
FIG. 1 is a top, plan view of the TAG FEEDING APPARATUS of this invention.
Figure 2:
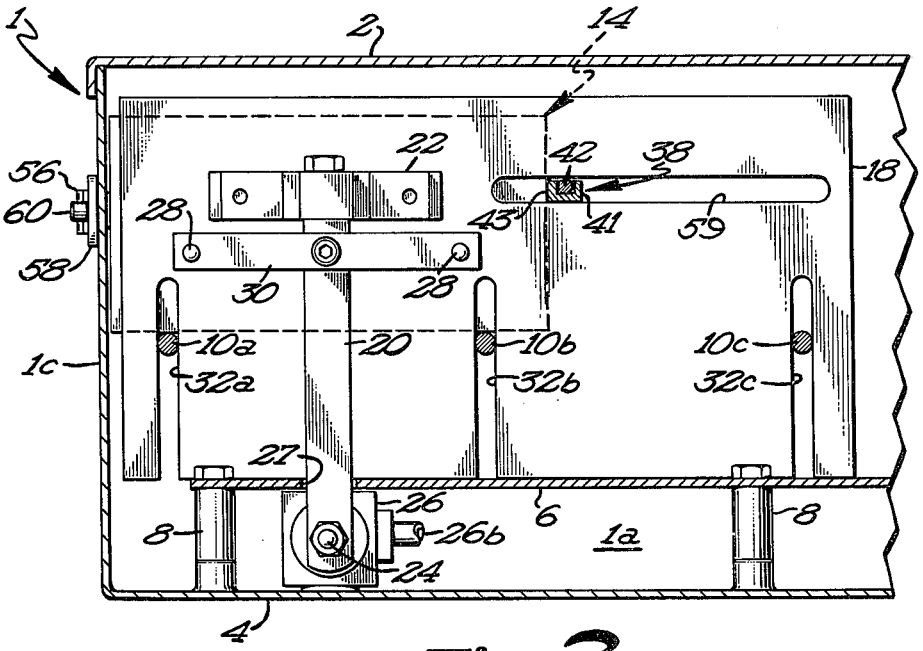
FIG. 2 is a vertical section view taken along lines 2—2 of FIG. 1.
Figure 3:
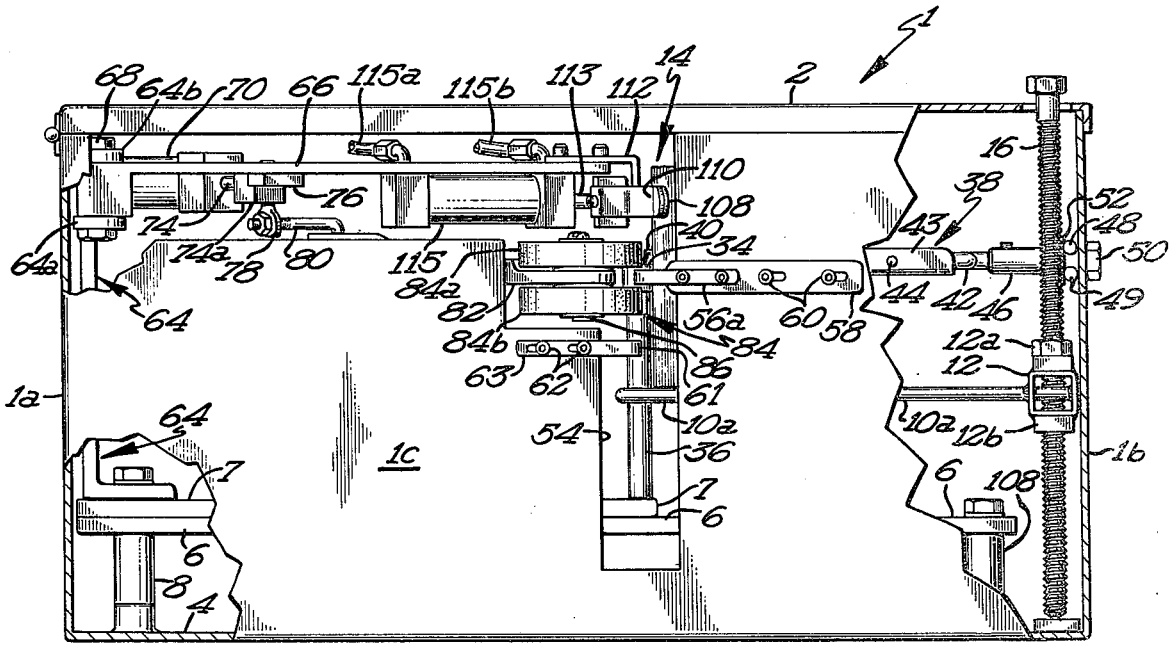
FIG. 3 is a side elevation view of the apparatus of FIG. 1, taken along lines 3—3 thereof.

Referring now to the drawings, I have shown in FIGS. 1–3 a preferred form of the tag feeding apparatus of this invention. The apparatus is preferably housed within a casing 1 having a hinged top lid 2. The cabinet 1 is of generally rectangular shape and comprises rear, front and side walls 1*a*, 1*b*, 1*c* and 1*d*. Bottom wall 4 of the cabinet supports a pair of base plates 6 and 7 on which various components of the tag feeding apparatus are mounted. Lowermost base plate 6 is supported by a plurality of pedestals 8.

FIGS. 1–3 also illustrate a preferred embodiment of means for holding a stack of tags. The tag holder comprises a combination of elements including a plurality of horizontal rods 10*a*, 10*b* and 10*c* affixed to a square bar 12. Rods 10*a*, 10*b* and 10*c* are spaced far enough apart horizontally to support the longest tags to be used with the tag feeding apparatus. A stack of tags generally indicated by reference numeral 14 is preferably supported in a vertical plane with the bottom edges of the tags resting on support rods 10*a*, 10*b* and 10*c*. A vertical height adjustment screw 16 extends through nuts 12*a* and 12*b* affixed to the top and bottom sides of square bar 12 as shown in FIG. 3 in threaded engagement therewith. Screw 16 may be rotated in opposite directions to raise and lower bar 12 and tag support rods 10*a*, 10*b* and 10*c* therewith. In this manner the height of support rods 10*a*, 10*b* and 10*c* may be adjusted to accommodate tags of varying height.

The tag holding means further comprises a follower plate 18 positioned vertically as shown in FIGS. 1 and 2. Plate 18 is mounted on an upstanding bracket arm 20 by means of a mounting bracket 22. Threaded fasteners or other suitable means may be utilized to attach plate 18 to mounting bracket 22. The bottom end of upstanding bracket arm 20 is affixed to the outer end of a reciprocating piston 24 of a power cylinder 26. Cylinder 26 is positioned below base plate 6 with slot 27 in plate 6 accommodating bracket arm 20. A pair of screws 28 carried on a crossbar 30 affixed to bracket arm 20 bear against the rear face of follower plate 18 and are utilized to adjust the angular position of plate 18 so that it bears evenly against the back face of tag stack 14. Tag support rods 10*a*, 10*b* and 10*c* extend through vertical slots 32*a*, 32*b* and 32*c* in follower plate 18 and are adjustable vertically therein by means of screw 16. Power cylinder 26 is provided with fluid supply and return lines 26*a* and 26*b*. The retraction of piston 24 urges follower plate 18 outwardly. Pressure is supplied to cylinder 26 at a controlled level in order to maintain a continuous, slight outward pressure on follower plate 18 in order to insure the continuous feeding of tags.

The outward force of follower plate 18 against the tag stack is resisted by an outer stack holder which preferably takes the form of at least one roller 34. Roller 34 is mounted on an upright bar 36 resting on base plate 7, as shown in FIGS. 1 and 3. Roller 34 is positioned to bear inwardly against the front face of tag stack 14 in opposed relation to piston 24 and follower plate 18.

An elongated rear stop bar 38 is positioned in restraining engagement with the rear or trailing edges of stacked tags 14. Stop bar 38 is preferably made from right angle bar stock, and has an enlarged, flat head portion 40 on its outer end positioned to abut against the front faces of stacked tags. Rear stop bar 38 extends horizontally, generally perpendicular to the plane of stacked tags as shown in FIGS. 1 and 3. For ease of inserting tags in the tag holding assembly, stop bar 38 is pivotally attached to a rear support rod 42 by means of a horizontally extending pivot pin 44. To this end the inner end of bar 38 is provided with an upstanding flange 41 which cooperates with right angle flange 43 to define a channel through which support bar 42 extends for connection to pivot pin 44. It will be understood that the outer end of stop bar 38 may be swung upwardly about pivot pin 44 to an out of the way position permitting easy insertion of tags between follower plate 18 and outer stack holding roller 34. The inner end of support rod 42 is secured within a socket 46 affixed to an elongated bracket bar 48, 49. Vertically spaced bars 48, 49 define a slotted bracket releasable secured to cabinet wall 1*b* by bolts 50 and a mounting plate 52. Bolts 50 extend through the opening between bars 48, 49 and can be loosened to permit the lateral adjustment of bracket bar 48, 49 and rear stop bar 38 therewith in order to accommodate different lengths of tags between rear stop bar 38 and sidewall 1*c* of cabinet 1. To this end stop bar 38 is movable back and forth within horizontal slot 59 in follower plate 18.

Means are also provided to retain the leading edges of tags in stack 14 adjacent an output side of the tag holding assembly defined by an opening 54 formed in cabinet sidewall 1*c*. Such leading edge retainer means preferably comprises an elongated retention finger 56 in combination with a clamping bracket 58 having an outer hooked end 58*a*. Bracket 58 is adjustably secured to cabinet sidewall 1*c* by fasteners 60 with its hooked outer end 58*a* extending through opening 54 a short distance to engage the leading edges of tags in stack 14. Hooked end portion 58*a* of bracket 58 cooperates with roller 34 and head portion 40 of rear stop bar 38 in containing tags in stack 14 and restraining them against the outward pressure of follower plate 18. Elongated retention finger 56 has a shank 56*a* attached to bracket 58. Outer clamping finger 56 angles outwardly away from its contact location with tag stack 14 towards output opening 54 of the tag holding assembly as illustrated in FIG. 1. As is hereinafter set forth with respect to the operation of the apparatus, elongated finger 56 serves as a ramp over which tags are guided one at a time to a freely displaced pickup position away from the remainder of the tag stack 14. The inner edge of retention finger 56 is beveled to provide a smooth surface over which the leading edges of separated tags may be directed as is most clearly illustrated in FIG. 7. Retention finger 56 is preferably formed of spring steel to provide pressure against the front face of the tag stack 14. Hooked outer end 58*a* of clamping bracket 58 provides a positive stop for the leading edges of tags. It is to be noted with respect to FIG. 1 that outer stack holding roller 34 is positioned substantially midway between rear stop bar 38 and leading edge retainer means 56, 58.

Also affixed to cabinet sidewall 1*c* is an elongated deflector pawl 63 having a curved outer end 61 positioned in opening 54. Deflector pawl 63 is mounted on cabinet wall 1*c* for lateral adjustment towards and away from the front face of the tag stack by means of fasteners 62 extending through slots therein. The purpose of deflector pawl 63 is to urge the bottom end of separated tags inwardly towards the front face of the tag stack. This forces the top end of a separated tag outwardly to a position assuring clamping engagement by a pickup device described below.

Figure 4:
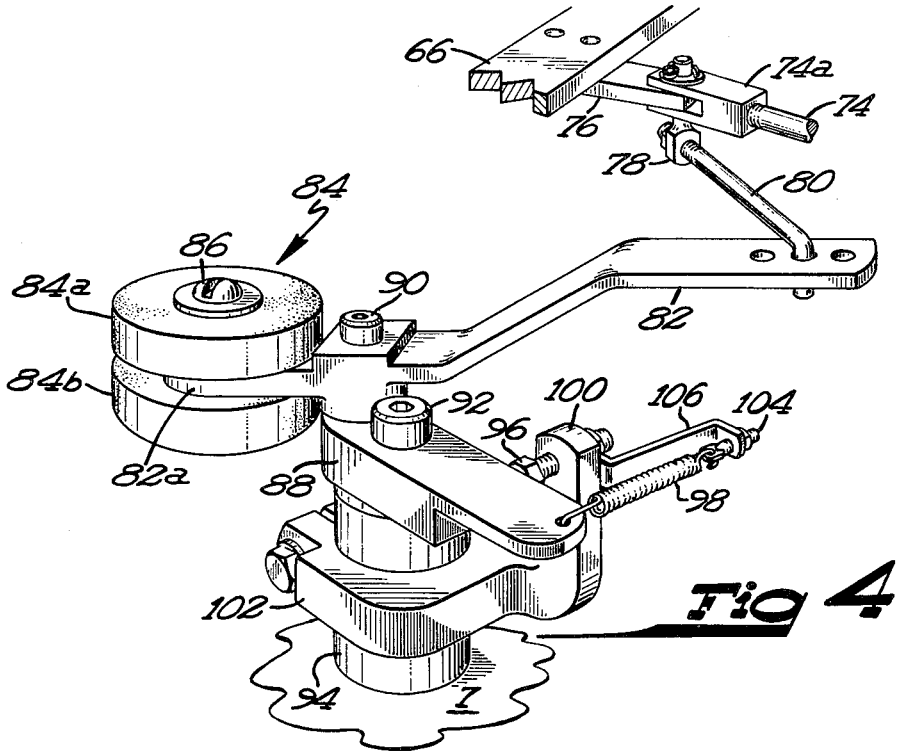
FIG. 4 is a fragmentary, perspective view of the tag buckling mechanism of this invention.

In FIGS. 1, 3 and 4 I have illustrated the operating mechanisms for separating and delivering tags from stack 14 and the associated support means therefor. A main support bracket 64 is mounted to base plate 7, and utilized to support power cylinders and associated swing arms. At its upper end bracket 64 has a horizontally extending support flange 64a which cooperates with a vertically spaced flange 64b at its forward end to define a mounting space for a swingable tag delivery arm 66. A pivot pin 68 extends through aligned apertures in bracket flanges 64a and 64b and through the rear end of delivery arm 66. The opposite end of bracket support flange 64a pivotally supports a main power cylinder 70 at pivot point 72. Piston 74 of cylinder 70 has a bifurcated end 74a as most clearly appears in FIG. 4 which is connected by a link 76 to tag delivery arm 66. This connection is accomplished by means of an eye bolt 78 which also supports at its lower end a connecting rod 80. One end of a tag displacement arm 82 is apertured to receive connecting rod 80. It will thus be seen that power cylinder 70 is utilized to actuate both tag delivery arm 66 and tag displacement arm 82. At its forward end arm 82 supports tag engaging means in the form of a friction contact head generally indicated by reference numeral 84. The purpose of head 84 is to frictionally engage tags in stack 14 and buckle them out from under tag leading edge retainer means 56, 58 in a manner hereinafter set forth. Friction head 84 can take various forms and be made out of any good friction contact material. I have found that two friction discs 84a and 84b made of rubber and supported in vertically spaced relation on extension 82a of tag displacement arm 82 in the manner shown in FIG. 4 serve particularly well to accomplish the desired tag separating function. Friction discs 84a and 84b are stationary and are rigidly secured to arm extension 82a by fastener 86.

Figure 7:
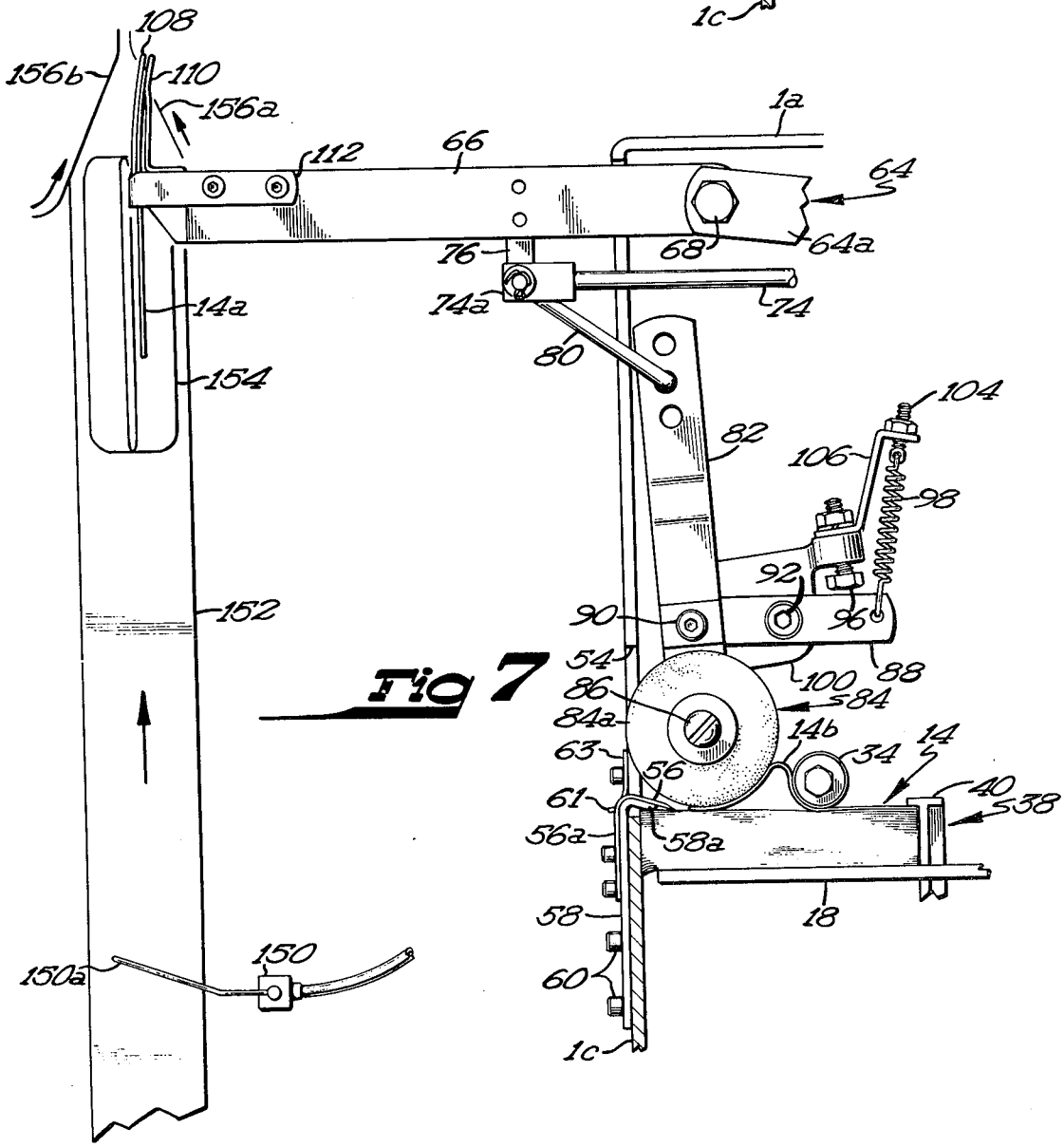

Tag displacement arm 82 is pivotally attached to a movable support bar 88 by pivot pin 90 extending therethrough. Support bar 88 is in turn pivotally movable on a pivot pin 92 by which it is secured to a stationary mounting pedestal 94. In order to ensure that contact head 84 will frictionally engage the first tag in stack 14 with the desired pressure to buckle the tag rearwardly as illustrated in FIG. 7, support bar 88 is initially pivotally adjusted on pivot pin 92. This is accomplished by means of an adjustable bolt 96 which serves as a stop against which the rear end of support bar 88 is normally urged by a spring 98. Adjustable stop bolt 96 threadedly engages an upright ear 100 on a split clamping block 102 mounted on pedestal 94. Coil spring 98 is attached between support bar 88 and a stud 104 threadedly engaging one end of a bracket arm 106. Stud 104 may be threadedly adjusted longitudinally in order to vary the tension on spring 98. Spring 98 normally urges the rear end of pivotal support bar 88 against the head of adjustable stop bolt 96. Bracket arm 106 is also attached as shown in FIG. 4 to upstanding ear 100 of clamping block 102.

Figure 5:
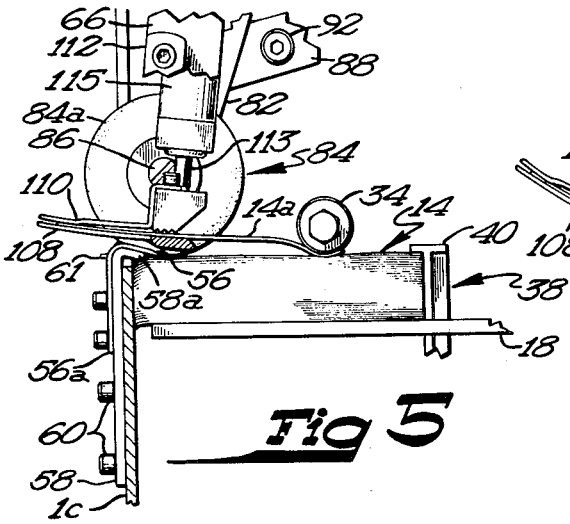
FIGS. 5–8 are fragmentary, top plan views showing the sequential positions of a tag displacement arm and a tag delivery arm in the course of separating a tag from a stack and delivering it to an application location.
Figure 8:
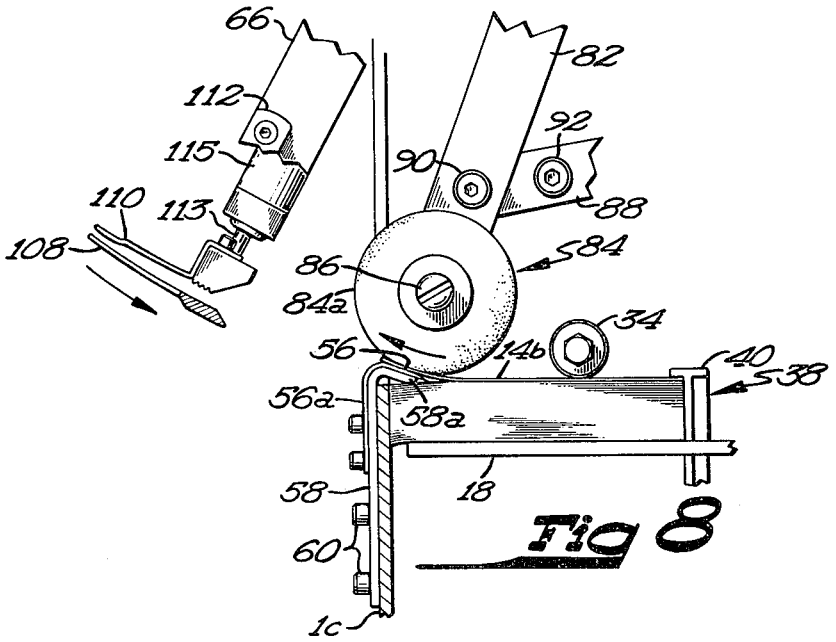

At its forward end tag delivery arm 66 mounts means for picking up tags separated from the stack one at a time by displacement arm 82. Such pickup means preferably comprises a clamping device comprising a pair of jaws 108 and 110 relatively movable towards and away from each other into tag clamping and release positions. Jaw 108 is stationary and is carried on the forward end of tag delivery arm 66 by an L-shaped bracket 112. As may be best understood by reference to FIGS. 3, 5 and 8, movable jaw 110 is carried on piston 113 of power cylinder 115. Cylinder 115 is supported from the underside of delivery arm 66. It is to be noted that the tag gripping ends of jaws 108 and 110 as shown in FIGS. 5 and 8 are beveled outwardly to provide a funnel shaped opening through which the leading edge of separated tags may be readily guided between the jaws. The extension of piston 113 by the actuation of cylinder 115 moves jaw 110 into tag clamping position with respect to fixed jaw 108.

In order to permit the convenient printing of desired coding information on tags 14 immediately prior to application and after the tags are stacked in the tag holding assembly I provide a movable printing head 114. Printing head 114 is removably positioned on a mounting block 116, preferably at a location adjacent the trailing ends of tags 14 between outer stack holder 34 and rear stop bar 38. As may best be understood by reference to FIGS. 1 and 9, printing head 114 is slidably supported on the front face of mounting block 116 by a pin 118 extending horizontally therethrough. Printing head 114 can be removed to change the printing information thereon by simply raising it upwardly as indicated in exploded position in FIG. 9. Horizontal pin 118 simply rests on top of mounting block 116 when printing head 114 is slidably lowered into position thereon. One or more printing channels 120, 121 are affixed to the front face of printing head 114 as by double faced, pressure sensitive tape 119. These channel shaped rails slidably support printing blocks 122 and 123 inserted therein. Any type of desired information can obviously be printed on the trailing ends of tags 14. For example, one of the printing blocks could be set up to print a date code and the other used to imprint any desired coding or bag content information.

Figure 9:
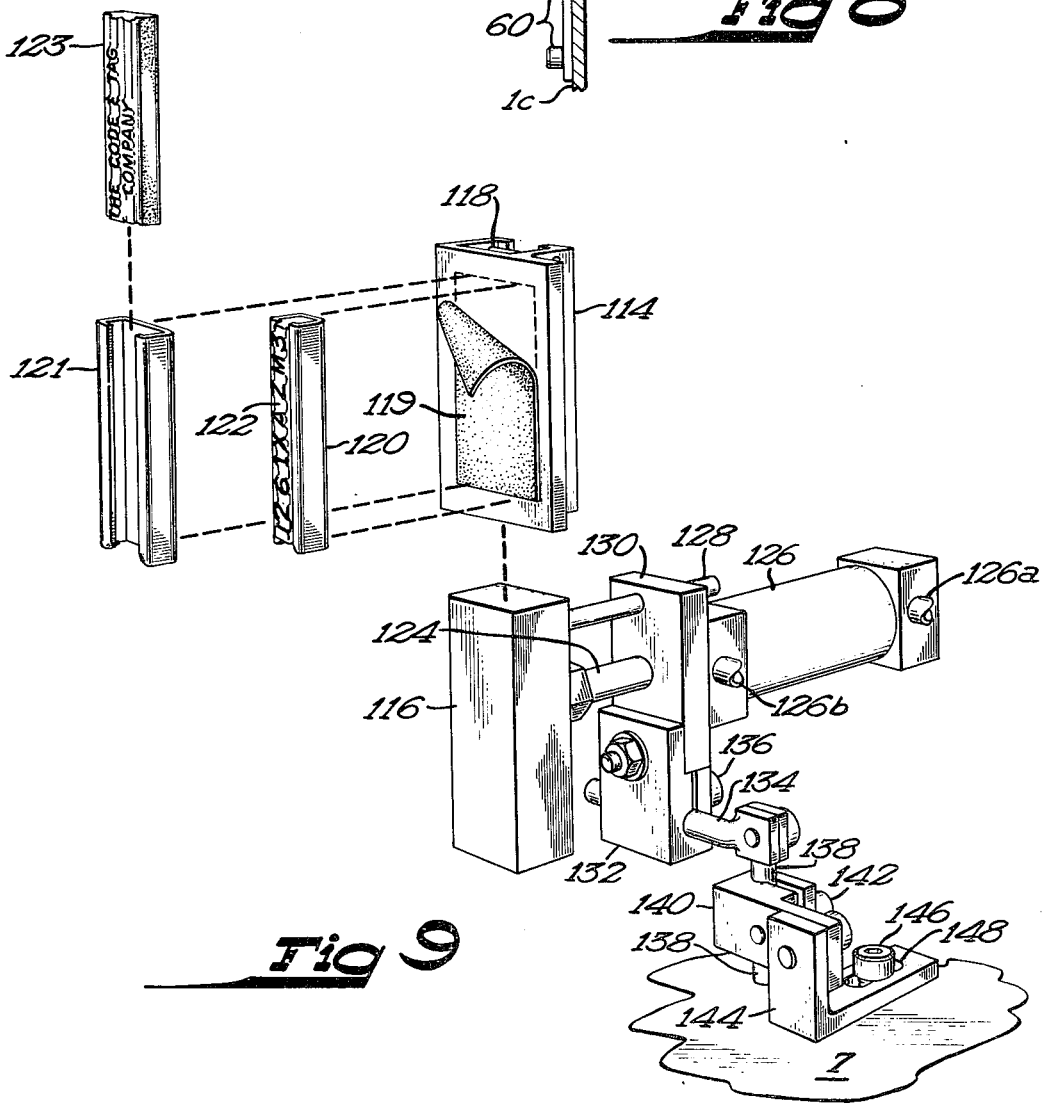
FIG. 9 is an exploded, perspective view of the tag printer.

As may best be understood by reference to FIG. 9, printer mounting block 116 is affixed to the forward end of a piston 124 of power cylinder 126. Printing cylinder 126 is oriented horizontally to move piston 124 in and out on printing and return strokes in a direction generally normal to the plane of tag stack 14. Mounting block 116 is further supported on a slide bar 128 which, along with piston 124, slides back and forth in a guide plate 130 affixed to support block 132. Block 132 is slidably supported on a horizontal rod 134 by adjusting screw 136. One end of rod 134 is affixed to a vertical pin 138 extending through a support block 140 and secured therein by an adjusting screw 142. The entire printer assembly is supported on base plate 7 by a mounting bracket 144. Fastener 146 extending through a slot 148 in the base of mounting bracket 144 may be loosened to adjust bracket 144 and the printing head 114 inwardly and outwardly with respect to tag stack 14. By loosening the screw 142, pin 138 may be raised and lowered within support block 140 to adjust the height of the printing head 114, and lateral adjustment of the printing head may be accomplished to align it with the trailing end of tags 14 by loosening screw 136. This permits support block 132 to be moved back and forth horizontally on rod 134.

As is indicated in FIG. 7, a limit switch 150 having a trip finger 150a is utilized to initiate operation of the tag feeding apparatus. Switch 150 is preferably positioned adjacent a conveyor 152 on which bags 154 or other types of containers are moved into position to be tagged. If bags are being labeled, they may be conveyed into a bag sealing or stitching machine having a funnel shaped receiving end comprised of moving belts 156a, 156b which pull the bag mouth into a stitching location. As is hereinafter set forth with respect to the operation of the apparatus, tag delivery arm 66 is moved by power cylinder 70 to a remote, delivery position wherein it delivers a tag 14a adjacent the mouth of bag 154 at the throat of the bag closing machine defined by belts 156a,

156*b*. Tag clamping jaws 108 and 110 release the tag against the bag mouth as shown in FIG. 7, with the tag then being held between the bag and belts 156*a*, 156*b* which convey the bag and tag to a position wherein the tag is affixed to the bag, as by stitching.

Figure 10:
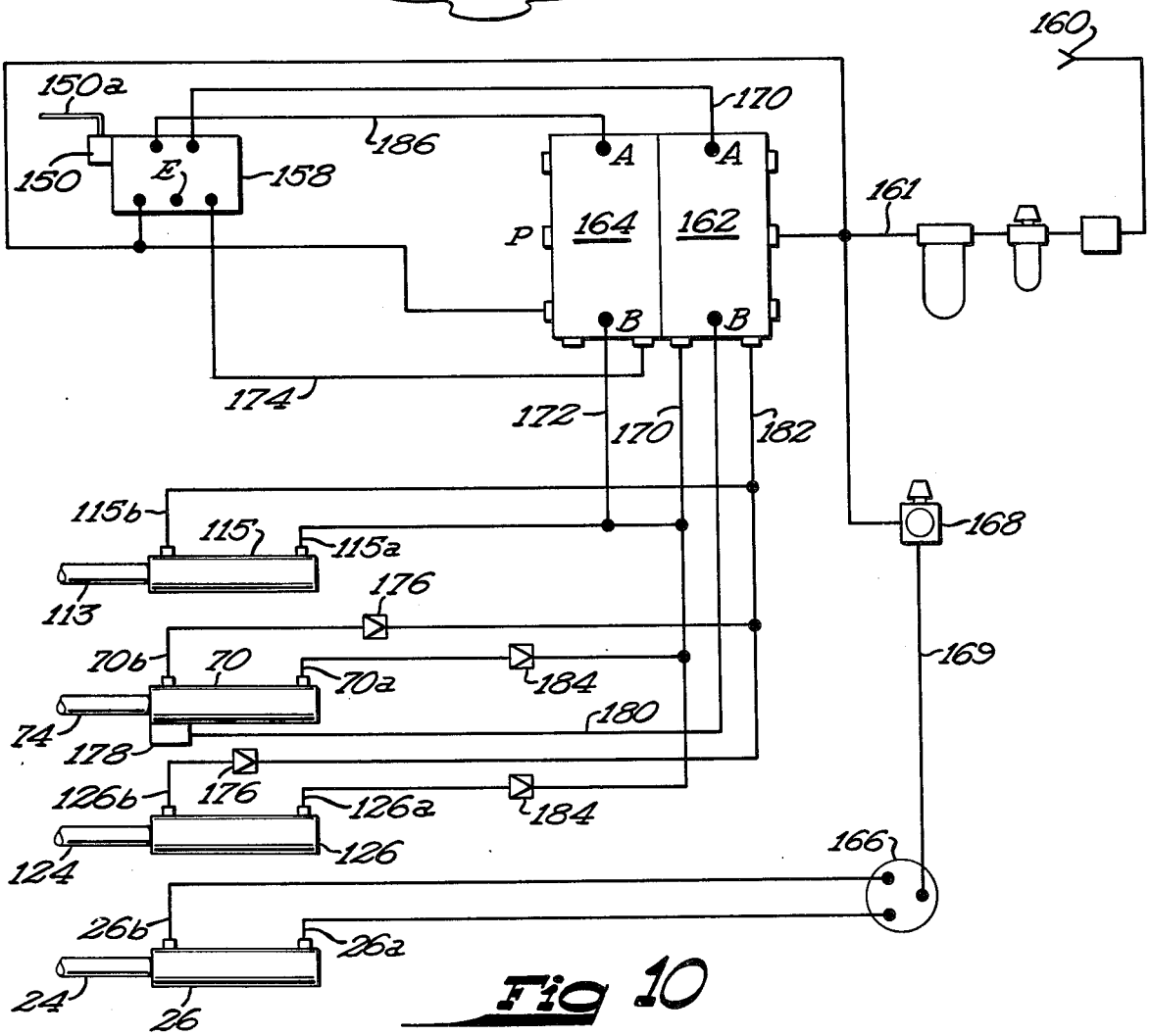
FIG. 10 is a schematic showing of the control arrangement for the power cylinders utilized to carry out the various tag separating, delivery and printing functions of the apparatus.

The flow control diagram of FIG. 10 shows limit switch 150 in operative relation with respect to a five way limit valve 158. Valve 158 is a standard, lever operated valve available from Numatics, Inc. of Highland, Michigan. Although various types of control arrangements may be utilized to actuate the powwer cylinders disclosed herein, a pneumatic system for this purpose has been disclosed. Limit valve 158 controls the flow of pressurized air from a supply source 160 and supply line 161 through power valve 162 and relay valve 164 to power cylinders 115, 70, 126 and 26. A hand operated valve 166 is utilized to manually control the flow of pressurized air to follower plate cylinder 26. Pressure regulator 168 in supply line 169 to hand valve 166 is set to maintain a desired pressure at cylinder 26. This ensures that power cylinder 26 will maintain pressure on follower plate 18 sufficient to properly contain and feed tags in stack 14.

Operation of the feeding mechanism is initiated when a bag 154 moves along conveyor 152 and trips finger 150*a* of limit switch 150. Switch 150 actuates valve 158 which shifts its position to pressurize line 170 and pilot port A on power valve 162. This causes power valve 162 to shift and deliver pressurized air to output line 170. Line 170 is connected as shown to tag clamping cylinder 115, swing arm cylinder 70 and printing cylinder 126 through their respective connecting lines 115*a*, 70*a* and 126*a*. At the same time, line 172 receives pressurized air from line 170 and pressurizes pilot port B on relay valve 164. This shifts relay valve 164 to exhaust line 174 through port P thereon. At the start of a cycle, the first tag 14*a* in the stack will be buckled as shown in FIG. 1 between clamping jaws 108 and 110. When cylinder 115 is actuated in the aforesaid manner by the tripping of limit switch 150, piston 113 is extended to move jaw 110 forwardly into clamping relation against tag 14*a* with respect to fixed clamp jaw 108. The actuation of cylinders 70 and 126 is delayed until a tag is clamped between jaws 108 and 110 by means of flow controls 176 in lines 70*b* and 126*b*. The actuation of cylinder 70 extends its piston 74. Tag delivery arm 66 connected thereto is then swung outwardly to the tag delivery position shown in FIG. 7 to position a tag for application to a container. The extension of piston 74 also pivots tag displacement arm 82 to initiate the buckling and separation of the next tag in the stack as hereinafter set forth. The actuation of cylinder 126 extends its piston 124 forwardly in a printing stroke. Pre-inked printing blocks 122 and 123 are thereby carried into printing contact with the trailing end of the next tag in the stack. Flow controller or restrictor 176 in line 126*b* ensures that this printing step does not take place until tag delivery arm 66 has swung forwardly with the previously buckled and displaced lead tag in the stack. When swing arm cylinder 70 reaches the end of its extension stroke, it actuates its stroke signal valve 178, which operates to pressurize pilot port B on power valve 162 through line 180. Power valve 162 is thereby shifted and its pressure port connected to line 182 is pressurized. Also, line 170 is exhausted at this time out port E of limit valve 158. Pressurized air is then delivered through line 182 and connecting lines 115*b*, 70*b* and 126*b* to the opposite ends of cylinders 115, 70 and 126. The retraction of piston 113 of cylinder 115 opens tag clamping jaws 108 and 110 to release a tag at the delivery position of arm 66. Flow restrictors 184 in lines 70*a* and 126*a* delay the retraction of pistons 74 and 124 until a tag has been released at the delivery position of arm 66. The retraction of piston 74 then operates to swing arm 66 back inwardly to the tag pickup position adjacent the output side of the tag holding assembly as shown in FIG. 1. The retraction of piston 124 of cylinder 126 moves printing head 114 outwardly, away from tag stack 14 on a return stroke.

When bag 154 passes limit switch trip finger 150*a*, switch 150 operates to shift valve 158 so as to pressurize line 186. This resets relay valve 164 at pilot port A and also pressurizes line 174 so that valves 162 and 164 are set for the beginning of another cycle.

Although the machine disclosed herein may be utilized for feeding tags or labels of various thicknesses and composition, the machine has been particularly designed with a view towards feeding relatively thin, paper tags within a thickness range between 0.003 and 0.010 inches. The machine is capable of separating and feeding any tag stock which will buckle in the manner hereinafter described without creasing. To insert a stack of such tags in the tag holding assembly, cylinder 26 is actuated by hand valve 166 to extend piston 24. This moves tag follower plate 18 back to a fully open position adjacent cabinet front wall 1*b*. Rear stop bar 38 is now free to be swung up to a vertical, out of the way position. Tags comprising stack 14 are loaded into position as shown in FIG. 1 and rear stop bar 38 is pivoted down to its normal position in restraining engagement with the trailing edges of tags 14. Bolts 50 may be loosened to adjust rear stop bar 38 laterally in order to bring it into contact with the trailing edges of the tags in the stack. Cylinder 26 is then actuated to retract piston 24 and follower plate 18, utilizing hand valve 166. It is to be noted that outer stack holder 34 is positioned between leading edge retainer means 56, 58 and trailing edge retainer or rear stop bar 38 in opposed relation to follower plate 18. Cylinder 26 maintains a predetermined pressure on plate 18 to urge the tag stack outwardly against outer stack holder 34, leading edge retainer means 56, 58 and head 40 of rear stop bar 38. The inwardly turned, hooked outer end 58*a* of bracket 58 affixed to side wall 1*c* serves as a positive retainer for the leading edges of tags 14.

Figure 6:
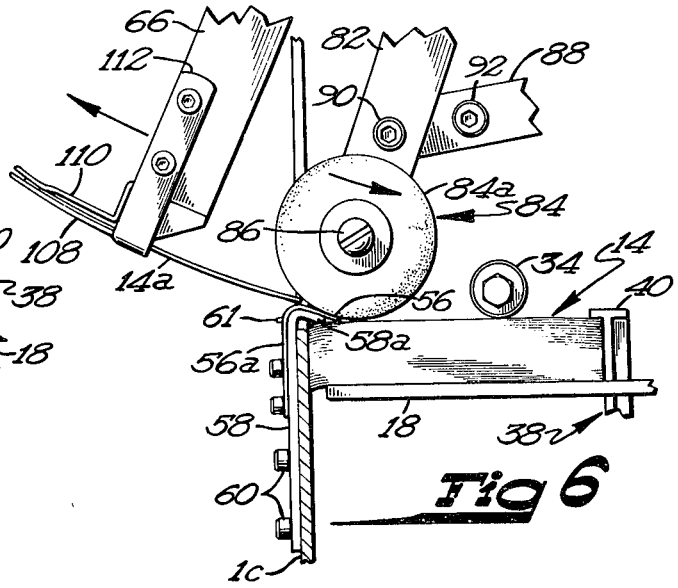

The control sequences which take place to carry out the operational steps of printing, separating and delivering tags one at a time from stack 14 have been described above with respect to FIG. 10. An operating cycle is initiated when a bag moves along conveyor 152 past trip finger 150*a* of limit switch 150. At this time tag delivery arm 66 and tag displacement arm 82 will be in the retracted positions shown in FIG. 1 with clamping jaws 108 and 110 in their tag pickup positions adjacent the output side of the tag holding assembly. A previously displaced tag 14*a* will have its leading end received between clamping jaws 108 and 110 in position to be gripped thereby. The tripping of limit switch 150 actuates cylinder 115 to extend piston 113. This moves gripping jaw 110 outwardly with the result that tag 14*a* is firmly clamped between jaws 108 and 110 as shown in FIG. 5. The subsequent extension of piston 74 pivots tag delivery arm 66 outwardly towards its tag delivery position as illustrated in FIGS. 5 and 6. Outer stack retention roller 34 is free to rotate as tag 14*a* is pulled out from between it and the remainder of stack 14 by the outward swinging movement of delivery arm 66. Since piston 74 is also secured to tag displacement arm 82 by connecting rod 80, the extension of piston 74 will also serve to swing arm 82 in a counterclockwise direction about pivot pin 90 as indicated in FIG. 6. Arms 66 and 82 are pivotally arranged and connected to piston 74 in such a way that friction contact head 84 will not be swung inwardly far enough to contact the next tag in the stack until tag 14*a* has been carried outwardly by arm 66 to the point that its trailing end clears contact head 84. This relationship between contact head 84 and delivery arm 66 is illustrated in FIG. 6 and ensures that contact head 84 will clear the trailing end of tag 14*a* being delivered as head 84 is swung inwardly on its tag displacement stroke. As contact head 84 continues its rearward or inward pivotal movement with displacement arm 82, friction discs 84*a* and 84*b* thereon will be brought into frictional engagement with the next tag 14*b* in stack 14. When this happens the reaction force generated by the initial contact of the stationary friction discs or tag engaging members 84*a*, 84*b* with stack 14 swings support bar 88 outwardly about pivot pin 92 in a clockwise direction. This movement of support bar 88 carries pivot pin 90 outwardly away from the front face of tag stack 14 as displacement arm 82 swings inwardly towards the stack. As a result, friction discs 84*a* and 84*b* trace a linear path which coincides with, and is parallel to, the front face of the next tag 14*b* in stack 14 as contact head 84 is swung rearwardly towards stop bar 38. On this rearward, linear stroke, friction discs 84*a*, 84*b* engage the next tag 14*b* in the stack and buckle its leading edge rearwardly out from under retention finger 56 and hooked outer end 58*a* of bracket 58 in the manner illustrated in FIG. 7. The buckling action of the lead tag is ensured by rear stop bar 38. Bar 38 and its enlarged head 40 prevent rearward displacement of tags in the stack on the rearward displacement stroke of contact head 84. This causes the lead tag to be buckled rearwardly in smooth, conforming relation to circular roller 34. It is to be noted that support bar 88 is pivoted away from stop bolt 96 at this time as illustrated in FIG. 7. Coil spring 98 maintains sufficient tension on bar 88 to ensure positive friction contact between discs 84*a*, 84*b* and the front face of the lead tag in the stack.

In FIG. 7, tag displacement arm 82 is shown at its rearmost tag displacement position. At this time piston 74 of cylinder 70 will be fully extended and tag delivery arm 66 will be simultaneously swung fully outwardly in a clockwise direction to its tag delivery position shown in FIG. 7. The subsequent retraction of piston 113 causes clamping jaws 108 and 110 to release tag 14*a* in application position against a bag 154. Piston 74 is then retracted to simultaneously swing tag delivery arm 66 back rearwardly to its tag pickup position and pivot tag displacement arm 82 forwardly on its return stroke as illustrated in FIG. 8. As tag delivery arm 82 swings forwardly towards its rest position shown in FIG. 1 on its return stroke friction discs 84*a* and 84*b* guide the leading end of the next tag 14*b* upwardly over the ramp surface defined by elongated retention finger 56. Since finger 56 angles outwardly away from tag stack 14, the leading end of tag 14*b* will be guided outwardly to a freely displaced pickup position wherein it is released from engagement by retention finger 56 and hooked end 58*a* of bracket 58. In this position the leading end of tag 14*b* will be in the path of clamping jaws 108 and 110. The chamfered or beveled end of retention finger 56 as illustrated in FIG. 7 ensures that the leading edge of the separated tag will move smoothly up over it to the position shown in FIG. 8. As tag delivery arm 66 is swung completely inwardly to the position shown in FIG. 1 by the retraction of piston 74, the separated leading end of tag 14*b* will be received between open jaws 108 and 110. The funnel shaped inner end of these jaws ensures that each tag will be smoothly received therebetween.

With respect to FIG. 3, it is to be noted that the curved outer end 61 of deflector pawl 63 is positioned at an elevation below swing arms 66 and 82 in the path of tags moving up over the ramp defined by retention finger 56. As a result the curved end 61 of pawl 63 urges the bottom of the displaced tag 14*b* slightly inwardly towards tag stack 14. This has the effect of deflecting the top end of the freed tag outwardly away from stack 14 in position for pickup by clamping jaws 108 and 110 on the return stroke of arm 66 to its tag pickup position shown in FIG. 1. Upon the full retraction of piston 74, tag displacement arm 82 will be returned to its rest position and delivery arm 66 will be swung inwardly to its tag pickup position as illustrated in FIG. 1 with the next tag received between clamping jaws 108 and 110. The next tag delivery cycle can then begin by the clamping of jaws 108 and 110 when the next bag moves past sensing finger 150*a* of limit switch 150.

Although circular rubber discs of the form shown at 84*a* and 84*b* have proven particularly effective as the friction contact members for buckling and separating tags from stack 14, other types of friction devices could be utilized on the end of tag displacement arm 82. For example, the friction head could simply be a straight rubber bar. It is also to be noted that the outer stack holder 34 need not necessarily take the shape of the circular rollers illustrated. However, such rollers do provide a smoothly curved surface over which tags may be easily buckled without creasing on the rearward, displacement stroke of friction head 84. Also, the means for picking up and delivering separated tags could comprise devices other than swing arm 66 and clamping jaws 108, 110. It is only necessary that some type of pickup device be utilized which can be moved to pick up the freed, leading end of a separated tag after it has been guided up over finger ramp 56 to a freely exposed pickup position by contact head 84 as shown in FIG. 8. I anticipate that various other modifications may be made in the size, shape and construction of the various components of the tag feeding apparatus disclosed herein without departing from the spirit and scope of my invention as defined by the following claims.

What is claimed is:

1. Tag feeding apparatus comprising:

tag holding means for supporting a stack of tags and comprising rear stop means for restraining the trailing edge of the tags, leading edge retainer means positioned adjacent an output side of said tag holding means to restrainably engage the leading edge of tags in a stack, and follower means for engaging the last tag in the stack and pressing said tag stack in a direction generally normal thereto to urge the first tag in the stack against said rear stop means and leading edge retainer means;

a tag delivery arm swingably movable between a tag pickup position adjacent the output side of said holding means and a remote, tag delivery position;

tag clamping means carried on said delivery arm and operable to clamp a tag at said tag pickup position;

a tag displacement arm having tag engaging means thereon, said tag displacement arm being swingably movable through a displacement stroke from a forward rest position to a rearward displacement position through a path wherein said tag engaging means contacts the first tag in said stack and displaces its leading edge rearwardly from said leading edge retainer means, and said tag displacement arm being movable through a return stroke back to said rest position wherein it carries said tag leading edge forwardly to a location free from said leading edge retainer means in position to be received and gripped by said clamp means with said delivery arm in said tag pickup position;

power means for swingably moving said delivery arm and displacement arm between said positions, said tag delivery arm and said tag displacement arm being mounted for pivotal movement about separate pivot points; and linkage means connecting said tag delivery arm and said tag displacement arm to said power means, said linkage means being operative in response to actuation by said power means to simultaneously swing said arms in opposite directions about said separate pivot points, with said tag displacement arm being moved rearwardly on said displacement stroke to free the next tag in a stack as said delivery arm is simultaneously swung forwardly to said delivery position with a previously displaced tag by the movement of said power means in a first direction, and with said tag displacement arm being moved forwardly through said return stroke to position a tag for pickup as said tag delivery arm is swung rearwardly to said tag pickup position by the movement of said power means in a second direction.

2. Tag feeding apparatus as defined in claim 1 wherein:

said power means comprises a power cylinder and piston unit connected to said linkage means at predetermined locations with respect to said pivot points for said arms so as to simultaneously swing said arms in said opposite directions when said power cylinder is actuated in said first and second directions.

3. Tag feeding apparatus as defined in claim 1 wherein:

said leading edge retainer means comprises a spring finger which exerts pressure on said tag stack adjacent the leading edges of said tags in opposed relation to said follower means.

4. Tag feeding apparatus as defined in claim 3 wherein:

said spring finger is an elongated, spring tensioned member angled away from its contact location with said tag stack towards said output side of said tag holding means to define a ramp over which tags are guided by said tag engaging means on said displacement arm to a freely displaced pickup position as said displacement arm moves through said return stroke to said rest position.

5. Tag feeding apparatus as defined in claim 1 wherein:

said tag engaging means comprises a circular member having a friction contact surface on its circular periphery which engages said tags, whereby the leading edge of the first tag in the stack is buckled rearwardly out from under said leading edge retainer means as said circular member frictionally engages the tag and urges it rearwardly against said rear stop means on said displacement stroke of said tag displacement arm.

6. Tag feeding apparatus as defined in claim 1 wherein:

said tag clamping means comprises a pair of jaws relatively movable towards and away from each other into tag clamping and release positions by power means operatively associated therewith.

7. Tag feeding apparatus as defined in claim 6 wherein:

said tags are oriented vertically in a stack and said clamping means is supported on said delivery arm at a location above said leading edge retainer means; and a deflector member located at said output side of said tag holding means below said leading edge retainer means in opposed relation thereto and positioned to urge the bottom of a freed tag towards said tag stack and thereby deflect the top end of the freed tag away from said stack in position for pickup by said clamping means on said delivery arm.

8. Tag feeding apparatus for handling relatively thin tags having a thickness between 0.003 and 0.010 inches comprising:

tag holding means for supporting a stack of tags and having a tag output side, said tag holding means comprising rear stop means for restraining tags in a stack against movement rearwardly away from said tag output side, leading edge retainer means positioned at said tag output side to restrainably engage a tag stack adjacent the leading edges of tags in a stack, follower means positioned to bear against the last tag in a stack in a direction generally normal thereto to urge the first tag in a stack against said leading edge retainer means and an outer stack holder positioned between said rear stop means and said leading edge retainer means to bear against the front face of the first tag in a stack in opposed relation to said follower means to resist the force of said follower means;

a tag displacement arm having a member thereon for engaging the first tag in a stack, said displacement arm being movable through a tag displacement stroke towards said rear stop means from a forward rest position to a rearward displacement position through a path wherein said tag engaging member remains between said leading edge retainer means and said outer stack holder and contacts the first tag in a stack and displaces its leading edge rearwardly from said leading edge retainer means, and said displacement arm being movable through a return stroke back to said rest position wherein it carries a tag leading edge forwardly to a pickup location at said tag output side free from said leading edge retainer means;

a tag delivery arm having tag pickup means thereon and movable between a tag pickup position adjacent the output side of said holding means and a remote tag delivery position;

first power means operably interconnected with said delivery arm and said displacement arm and movable in first and second directions for simultaneously moving said delivery arm and said displacement arm between said positions, with said displacement arm being moved rearwardly on said displacement stroke to free the next tag in a stack as said delivery arm is swung forwardly to said delivery position with a previously displaced tag by the movement of said power means in a first direction, and with said tag displacement arm being moved forwardly through said return stroke to position a tag for pickup as said tag delivery arm is swung rearwardly to said tag pickup position by the movement of said power means in a second direction;

a printing head positioned between said rear stop means and said outer stack holder out of the path of movement of said delivery arm and said displacement arm, said printing head being reciprocally movable towards a stack of tags in said tag holding means on a printing stroke and away therefrom on a return stroke in a direction normal to the plane of tags stacked in said holding means to imprint the first tag in a stack; and second power means for moving said printing head back and forth through said printing and return strokes.

9. Tag feeding apparatus as defined in claim 8 wherein:

said outer stack holder comprises at least one rotatably supported roller member, whereby said tag pickup means can pick up the leading end of a separated tag adjacent the freed, leading edge thereof and pull the tag out of a stack with said roller rotating as the tag is pulled out from between it and the remainder of the tag stack.

10. Tag feeding apparatus as defined in claim 9 wherein:

control means is operatively associated with said tag displacement arm and said second power means for said printing head, said control means being operable to actuate said second power means to move said printing head on said printing stroke immediately prior to actuating said tag displacement arm.

11. Tag feeding apparatus comprising:

tag holding means for supporting a stack of tags and having a tag output side, said tag holding means comprising rear stop means for restraining tags in a stack against movement rearwardly away from said tag output side, leading edge retainer means positioned at said tag output side to restrainably engage a tag stack adjacent the leading edges of tags in a stack, and follower means positioned to bear against the last tag in a stack in a direction generally normal thereto to urge the first tag in a stack against said leading edge retainer means;

a tag displacement arm having a member thereon for engaging the first tag in a stack, said displacement arm being movable through a tag displacement stroke towards said rear stop means from a forward rest position to a rearward displacement position through a path wherein said tag engaging member contacts the first tag in a stack and displaces its leading edge rearwardly from said leading edge retainer means, and said displacement arm being movable through a return stroke back to said rest position wherein it carries a tag leading edge forwardly to a pickup location at said tag output side free from said leading edge retainer means;

a tag delivery arm having tag pickup means thereon and movable between a tag pickup position adjacent the output side of said holding means and a remote tag delivery position;

power means movable in first and second directions for swingably moving said delivery arm and said displacement arm between said positions, said delivery arm and said displacement arm being mounted for pivotal movement about separate pivot points, and said delivery arm and said displacement arm being connected to said power means at predetermined locations with respect to said separate pivot points for simultaneous/actuation by said power means, with said displacement arm being moved rearwardly on said displacement stroke to free the next tag in a stack as said delivery arm is simultaneously swung forwardly to said delivery position with a previously displaced tag by the movement of said power means in a first direction, and with said tag displacement arm being moved forwardly through said return stroke to position a tag for pickup as said tag delivery arm is swung rearwardly to said tag pickup position by the movement of said power means in a second direction.

12. Tag feeding apparatus as defined in claim 11 wherein:

said tag holding means comprises an outer stack holder positioned to bear against the front face of the first tag in a stack in opposed relation to said follower means to resist the force of said follower means, said outer stack holding being positioned between said rear stop means and said leading edge retainer means;

a movable printing head is positioned between said rear stop means and said outer stack holder, said printing head being reciprocally movable towards a stack of tags in said tag holding means on a printing stroke and away therefrom on a return stroke in a direction generally normal to the plane of tags stacked in said holding means to imprint the first tag in the stack; and second power means for moving said printing head back and forth through said printing and return strokes.

13. Tag feeding apparatus as defined in claim 12 wherein:

control means is operatively associated with said power means for said displacement arm and said printing head respectively, said control means being operable to actuate said second power means to move said printing head on said printing stroke immediately prior to the movement of said tag displacement arm through said tag displacement stroke.

14. Tag feeding apparatus as defined in claim 11 wherein: said tag engaging member has a friction contact surface thereon positioned to engage the front face of the first tag in a stack in said holding means and urge said tag rearwardly against said stop means to buckle the leading end of said first tag rearwardly free of said leading edge retainer means on said displacement stroke of said displacement arm and thereby separate the leading edge of the first tag from the stack.

15. Tag feeding apparatus as defined in claim 14 wherein:

said tag engaging member is supported on said displacement arm for movement by said power means in a linear path parallel to the plane defined by the outer face of said first tag of a stack supported by said holding means, after said tag engaging member contacts the first tag on said tag displacement stroke.

16. Tag feeding apparatus as defined in claim 15 wherein:

said tag displacement arm is swingably movable by said power means about one of said pivot points on a movable support member, said support member being movable outwardly away from the front face of said first tag of a stack in said tag holding means in response to the reaction force generated through said tag displacement arm by initial contact of said tag engaging member with said stack as said tag engaging member moves towards said rear stop means on said displacement stroke, whereby said pivot point location moves outwardly away from said stack with said support member as said tag displacement arm swings inwardly towards the stack on said displacement stroke to thereby generate said linear path of said tag engaging member during said tag buckling action on said displacement stroke.

17. Tag feeding apparatus as defined in claim 11 wherein:

said power means comprises a power cylinder having a piston reciprocally movable in said first and second directions, and said piston is connected to said tag delivery arm and said tag displacement arm by linkage means.

18. Tag feeding apparatus as defined in claim 11 wherein:

said follower means exerts a force on said tag stack in a direction generally normal to the plane of tags in a stack; and said tag holding means further comprises an outer stack holder positioned to bear against the front face of the first tag in said stack in opposed relation to said follower means to resist the force of said follower means on a tag stack, said outer stack holder comprising at least one rotatably supported roller member, whereby said pickup means can pickup the leading end of a separated tag adjacent the freed leading edge thereof and pull the tag out of a tag stack with said roller rotating as a tag is pulled out from between it and the remainder of a tag stack.

19. Tag feeding apparatus as defined in claim 18 wherein:

said tag engaging member has a friction contact surface thereon positioned to engage the front face of the first tag in a stack in said holding means and urge said tag rearwardly against said stop means to buckle the leading end of the first tag rearwardly free of said leading edge retainer member on said displacement stroke of said displacement arm and thereby separate the leading end of the first tag from a stack; and said outer stack holder roller member is positioned between said leading edge retainer means and said rear stop means, and tags are buckled up against said roller member by said tag engaging member on said displacement stroke of said tag displacement arm.

20. Tag feeding apparatus as defined in claim 19 wherein:

said roller has an arcuate peripheral surface against which the first tag in a stack is buckled in a conforming arcuate configuration therewith by said tag engaging member.

* * * * *